United States Patent [19]

Crookston et al.

[11] 4,438,306

[45] Mar. 20, 1984

[54] CIRCUIT INTERRUPTER OPERATING MECHANISM HAVING A CHEMICAL OPERATOR WITH A STATIONARY PISTON

[75] Inventors: Ronald W. Crookston, Penn Township, Westmoreland County; Ivan T. Burney, Plum, both of Pa.

[73] Assignee: Westinghouse Electric Corp., Pittsburgh, Pa.

[21] Appl. No.: 339,605

[22] Filed: Jan. 15, 1982

[51] Int. Cl.[3] ..... H01H 33/42

[52] U.S. Cl. ..... 200/148 F; 200/82 B; 200/148 R

[58] Field of Search ..... 200/148 F, 82 B, 148 R

*Primary Examiner*—Robert S. Macon
*Attorney, Agent, or Firm*—M. S. Yatsko

[57] ABSTRACT

An electric circuit interrupter comprising a drive mechanism with a stationary drive piston and a movable drive cylinder for actuating an operating mechanism to selectively open and close a pair of separable contacts.

6 Claims, 3 Drawing Figures

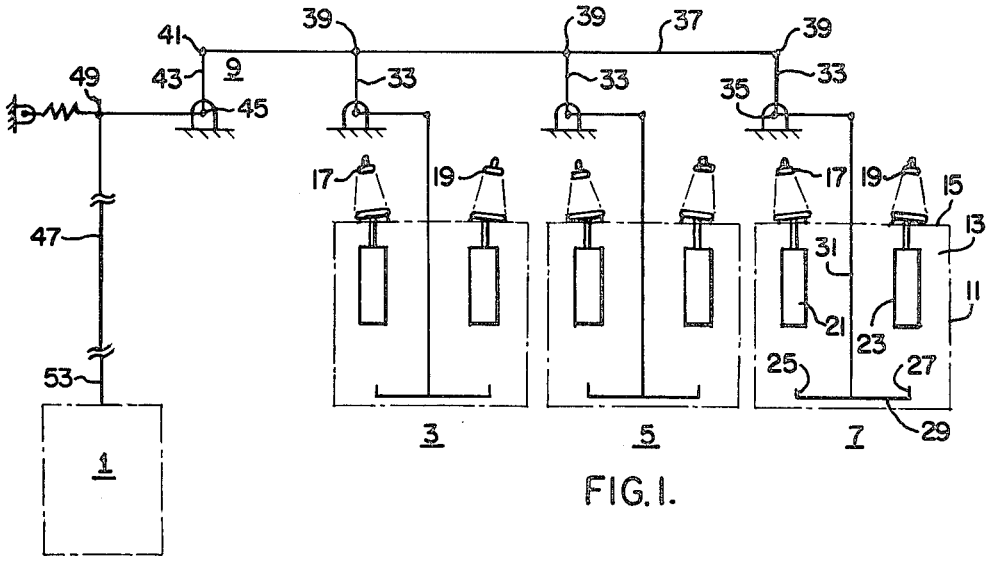
FIG. 1.
FIG. 2.
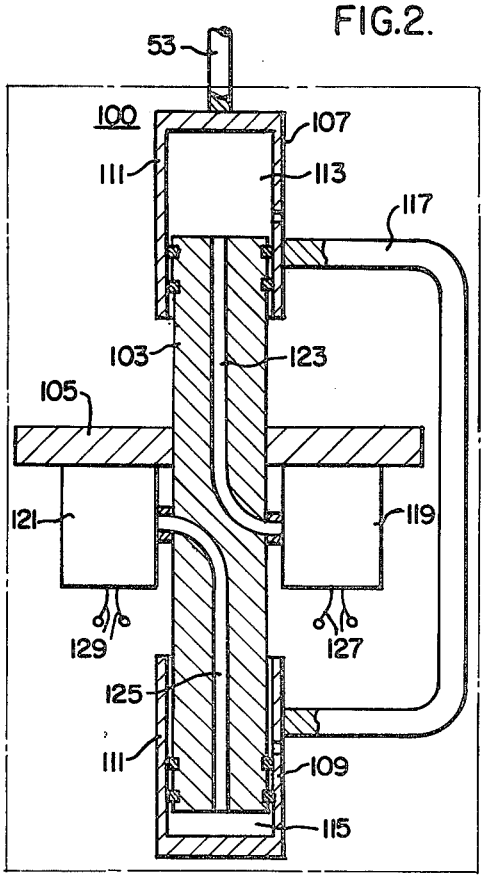
FIG. 3.
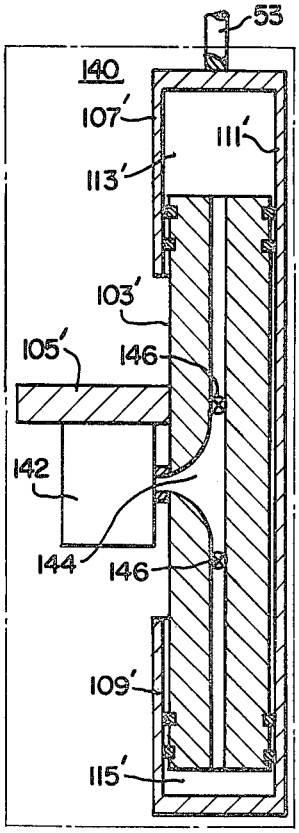

CIRCUIT INTERRUPTER OPERATING MECHANISM HAVING A CHEMICAL OPERATOR WITH A STATIONARY PISTON

CROSS-REFERENCE TO RELATED APPLICATIONS

This application is related to concurrently filed copending application Ser. No. 339,604, filed Jan. 15, 1982 entitled "Circuit Interrupter Operating Mechanism Having A Chemical Operator Reloader With Stationary Combustion Chambers" by R. W. Crookston and I. T. Burney.

BACKGROUND OF THE INVENTION

1. Field of the Invention

The invention relates in general to a circuit interrupter operating mechanism and in particular to a chemical operator drive means having a stationary piston and a movable drive cylinder.

2. Description of the Prior Art

Modern circuit interrupter operating drive mechanisms may employ a chemical operator drive mechanism comprising a chemical gas generator which ignites a propellant charge of expulsive material to propel a high pressure gaseous medium through a conduit into a drive piston and cylinder assembly. When the chemical propellant drive mechanism is used for both the opening and closing of the circuit interrupter contacts an inherent problem plagues the piston cylinder assembly, namely destruction of the shaft seal. In a combustion device such as a chemical propellant mechanism, combustion produces residues which deposit on the piston drive rod and creates the problems of abrasion and "gumming" for the piston rod shaft seal. Accordingly, it would be desirable to have a drive mechanism piston cylinder assembly which would not require piston rod shaft seal.

SUMMARY OF THE INVENTION

Briefly the present invention is a new and improved electric circuit interrupter comprising a pair of separable contacts, operating means for opening and closing the contacts and a drive means for driving the operating means including a stationary drive piston and a movable drive cylinder operatively connected to the operating means, and a pressure generating means for generating an expulsion of gaseous medium through conduit means into the drive cylinder or drive displacement cavity. One preferred embodiment of the invention comprises a double acting drive piston and cylinder assembly having first and second displacement cavities wherein the conduit means includes valve means for directing the expulsion of gases into either of the first or second displacement cavities to selectively cause the drive cylinder to move in either of two opposite directions. Another preferred embodiment includes first and second gas generators each capable of generating an expulsion of gaseous medium and first and second conduit means for channeling the expulsion of gaseous mediums between the first and second gas generators into the first and second displacement cavities respectively to again provide for selectively moving the drive cylinder in either of two opposite directions.

BRIEF DESCRIPTION OF THE DRAWINGS

The invention may be understood, and further advantages and uses thereof more readily apparent, when considered in view of the following detailed description of exemplary embodiments, taken with the accompanying drawings, in which:

FIG. 1 is a diagrammatic elevational view, partly in section, showing a three-phase oil power circuit breaker, operating mechanism and drive means constructed according to the teachings of the invention;

FIG. 2 is a vertical sectional view of one embodiment of the drive means shown generally in FIG. 1; and FIG. 3 is another embodiment of the drive means shown generally in FIG. 1.

DESCRIPTION OF THE PREFERRED EMBODIMENT

Referring now to the drawings and to FIG. 1 in particular a drive mechanism is generally indicated at 1 and is operatively connected to a plurality of circuit interrupters 3, 5, 7 of conventional type, such as oil-break, air-break, or gas-blast type. Operating means, generally indicated at 9, extend between the drive mechanism 1 and the circuit breakers 3, 5, 7, each of which is similar to that shown in the sectional view of the breaker 7 and is typical of such breakers, as shown more particularly in U.S. Pat. No. 2,477,788 hereby incorporated by reference herein. It comprises a tank 11 containing a suitable arc-extinguishing fluid 13, a cover 15, and two terminal bushings 17, 19. Spaced stationary contacts means 21, 23 are provied at the lower end of the terminal bushings 17, 19 which operate in conjunction with movable contacts 25, 27 mounted on a bridging contact member 29 at the lower end of an operating rod 31.

The upper end of each operating rod 31 is pivotally secured to lever means, such as, for example, a bell crank 33, which is stationarily pivoted at 35. A link 37 is pivoted at 39 to each bell crank 33 and at its other end is pivoted at 41 to a bell crank 43, which in turn is stationarily pivoted at 45. A link 47, pivoted at 49 to the other end of the bell crank 43, is a vertical pull rod and is connected to a drive rod 53 of drive means or drive mechanism 1. The operating mechanism 9 comprises the several parts 31, 33, 37, 43 and 47.

Referring now to FIG. 2 there is shown one embodiment of the drive mechanism constructed according to the teachings of the invention referred to generally at 1 in FIG. 1. Drive means 100 includes a stationary drive piston 103 rigidly attached to frame 105, and being enveloped by first and second ends, 107, 109, respectively of movable drive cylinder 111 to define first and second displacement cavities 113, 115, respectively. First and second ends 107 and 109 of movable drive cylinder 111 are connected by drive cylinder connecting link or yoke 117 and first end 107 is connected to drive rod 53. Movable drive cylinder 111 has exhaust ports 112 disposed therein at a location to exhaust gas pressure at a position which is determined by the performance required of drive means 100. First and second generator means 119 and 121, respectively, for generating a sudden expulsion of gaseous medium, are connected to stationary drive piston 103 by means of first and second conduit means 123 and 125, respectively. First and second generator means 119 and 121, which may be of the reloader type, may also be attached to frame 105 as shown in FIG. 3 for greater support. Although the invention is not limited thereto, the construction and operation of a generator means is set forth more particularly in U.S. Pat. No. 4,271,341, which is hereby incorporated by reference. Briefly, the first and second generator means 119, 121 are gas generators of the chemical propellant type comprising a propellant charge of expulsive material which upon ignition by an electric initiator or firing pin arrangement ignite to propel a high pressure gaseous medium through first and second conduit means 123, 125, which may be for example standard gas lines, conduits and/or passages in the piston capable of withstanding the gas pressures generated by gas generators 119, 121 into first and second displacement cavities 113, 115, respectively. An example of the propellant charge is a single or double-base smokeless gun powder which may generate a gas pressure of from about 3,000 to 10,000 psi or higher within the first and second displacement cavities 113, 115, respectively, to selectively cause movable drive cylinder 111 to move in either of two opposite directions thereby moving drive rod 53 in either of two opposite directions for urging the contacts of circuit interrupters 3, 5, 7 to either the open or closed positions. In operation the propellant charge of expulsive material is ignited in first generator means 119 by an electric initiator provided by conductors 127 (or by a mechanical firing pin device, not shown) to propel a high pressure gaseous medium through first conduit means 123 into first displacement cavity 113 which drives movable drive cylinder 111 upward thereby moving drive rod 53 upward, and thereby opening the contacts in circuit interrupters 3, 5, 7. Similarly, when the propellant charge of expulsive material in second generator means 121 is ignited as for example by an electric impulse provided by conductors 129 (or firing pin detonator as hereinabove explained), a high pressure gaseous medium is propelled through second conduit means 125 into second displacement cavity 115 thereby forcing movable drive cylinder 111 and attached drive rod 53 downward, thereby closing circuit interrupters 3, 5, 7. An overtoggle latch 131 including overtoggle spring 133 and mounting means 135 is provided to hold the circuit breaker in the open or closed position. Overtoggle spring 133 exerts a force to maintain the breaker in the position which it is in.

Referring now to FIG. 3 there is shown another embodiment of the drive means constructed according to the teachings of the invention in which primed numbers refer to similar parts with modification to those shown in FIG. 3. Drive means 140 is similar in structure and operation to drive means 100 except that the alternate design of drive means 140 utilizes a single gas generator means 142 and a single conduit means 144 having valve means 146 for channeling the expulsive gas pressure of the ignited propellant charge to either the first displacement cavity 113' or the second displacement cavity 115' in order to selectively cause movable drive cylinder 111' to move in either of two opposite directions to provide for selectively opening or closing circuit interrupters 3, 5, 7. Conduit means 123, 124, 144 may for example be standard gas lines, conduits and/or piston passages capable of withstanding the pressures generated by the gas generators. Valve means 146 might for example be solenoid operated spool valves with metallic rings for reliable operation or other suitable valving operated by the gas pressure expulsion itself.

In conclusion there has been disclosed drive means which utilizes a unique concept to overcome an inherent problem with piston cylinder drive assemblies, namely, destruction of the shaft seal. The drive means according to the teachings of the invention utilize fixed drive pistons and movable drive cylinders in order to eliminate the problems of abrasion and gumming due to the propellant combustion residues which deposit on the piston drive shafts of standard piston cylinder drive assemblies. Although the preferred embodiments of the invention described herein were developed in order to solve certain problems within circuit interrupter apparatus, the invention is not limited to such circuit interrupter applications but rather is broadly applicable to any single or double acting gas pressure drive cylinder piston arrangement.

We claim:

1. An electric circuit interrupter, comprising:

a pair of separable contacts;

operating means operatively connected to said contacts for opening and closing said contacts;

drive means operatively connected to said operating means for driving the operating means including a stationary drive piston and a movable drive cylinder enveloping said drive piston to define a drive displacement cavity; and pressure generating means for generating an expulsion of gaseous medium into said drive displacement cavity.

2. The electric circuit interrupter of claim 1 wherein the drive piston and the drive cylinder have first and second ends respectively and wherein the first and second ends of the drive cylinder envelope the first and second ends of the drive piston to provide first and second displacement cavities, and wherein said pressure generating means includes valve means for directing the expulsion of gases into either said first or second displacement cavities to selectively cause said drive cylinder to move in either of two opposite directions.

3. The electric circuit interrupter of claim 1 wherein the drive piston and the drive cylinder have first and second ends respectively with the first and second ends of the drive cylinder enveloping the first and second ends of the drive piston to provide first and second displacement cavities, and wherein the pressure generating means includes first and second gas generators each capable of generating an expulsion of gaseous medium, and first and second conduit means operably connected between and for channeling the expulsion of gaseous medium between said first and second gas generators and said first and second displacement cavities to provide for selectively moving said drive cylinder in either of two opposite directions.

4. A drive mechanism for moving a load, comprising:

a drive means operatively connected to said load for moving said load including a stationary drive piston and a movable drive cylinder enveloping the drive piston to define a drive displacement cavity; and pressure generating means for generating an expulsion of gaseous medium into said drive displacement cavity.

5. The drive mechanism of claim 4 wherein the drive piston and the drive cylinder have first and second ends respectively and wherein the first and second ends of the drive cylinder envelope the first and second ends of the drive piston to provide first and second displacement cavities, and wherein said pressure generating means includes valve means for directing the expulsion of gases into either said first or second displacement cavities to selectively cause said drive cylinder to move in either of two opposite directions.

6. The drive mechanism of claim 5 wherein the drive piston and the drive cylinder have first and second ends respectively with the first and second ends of the drive cylinder enveloping the first and second ends of the drive piston to provide first and second displacement cavities, and wherein the pressure generating means includes first and second gas generators each capable of generating an expulsion of gaseous medium, and first and second conduit means operably connected between and for channeling the expulsion of gaseous medium between said first and second gas generators and said first and second displacement cavities to provide for selectively moving said drive cylinder in either of two opposite directions.

* * * * *